US010501309B2

(12) United States Patent
Liu et al.

(10) Patent No.: US 10,501,309 B2
(45) Date of Patent: Dec. 10, 2019

(54) FREQUENCY VARIABLE FUEL VAPOR RECOVERY CONTROL SYSTEM AND METHOD FOR FUEL DISPENSER WITH SELF-CALIBRATED VAPOR LIQUID RATIO

(71) Applicant: SOUTH CHINA UNIVERSITY OF TECHNOLOGY, Guangzhou Guangdong Province (CN)

(72) Inventors: Yajun Liu, Guangzhou (CN); Maoqing Li, Guangzhou (CN); Yeqing Chen, Guangzhou (CN)

(73) Assignee: SOUTH CHINA UNIVERSITY OF TECHNOLOGY, Guangzhou, Guangdong Province (CN)

( * ) Notice: Subject to any disclaimer, the term of this patent is extended or adjusted under 35 U.S.C. 154(b) by 140 days.

(21) Appl. No.: 15/536,445

(22) PCT Filed: Jun. 30, 2015

(86) PCT No.: PCT/CN2015/082837

§ 371 (c)(1),
(2) Date: Jun. 15, 2017

(87) PCT Pub. No.: WO2016/095486

PCT Pub. Date: Jun. 23, 2016

(65) Prior Publication Data

US 2017/0349427 A1 Dec. 7, 2017

(30) Foreign Application Priority Data

Dec. 19, 2014 (CN) ..... 2014 1 0811474

(51) Int. Cl.
*B67D 7/04* (2010.01)
*B67D 7/54* (2010.01)
(Continued)

(52) U.S. Cl.
CPC ..... *B67D 7/04* (2013.01); *B67D 7/0482* (2013.01); *B67D 7/0486* (2013.01);
(Continued)

(58) Field of Classification Search
CPC ..... B67D 7/04; B67D 7/0482; B67D 7/0496; B67D 7/0486; B67D 7/54; B67D 7/78; B67D 7/36; F17C 5/02
See application file for complete search history.

(56) References Cited

U.S. PATENT DOCUMENTS 5,156,199 A 10/1992 Hartsell, Jr. et al.
5,269,353 A 12/1993 Nanaji et al.
(Continued)

FOREIGN PATENT DOCUMENTS

CN 101450780 A 6/2009
CN 102173371 A 9/2011
(Continued)

OTHER PUBLICATIONS

First China Office Action for counterpart patent application/publication No. 201410811474.4.
(Continued)

*Primary Examiner* — Nicolas A Arnett
(74) *Attorney, Agent, or Firm* — Dickinson Wright PLLC

(57) ABSTRACT

A fuel vapor recovery control system includes a controller, a recovery electrical motor, a fuel vapor switching valve, a fuel vapor recovery pump, a fuel tank, a fueling pump, a fuel gun, and a temperature sensor connected in sequence. A fueling flowmeter is arranged on a fueling pipeline, in signal connection with the controller, the recovery electrical motor and the fuel vapor recovery pump in sequence. The temperature sensor is in signal connection with the controller for controling the recovery electrical motor and the fuel vapor recovery pump by temperature signals. The fuel vapor recovery control system includes a fuel vapor flowmeter for measuring the fuel vapor recovery amount, in signal connection with the controller for controling the recovery electrical motor and the fuel vapor recovery pump by fuel vapor recovery amount signals. The fuel vapor recovery
(Continued)

ratio is between 1-1.4. A method of adopting the system is provided herein.

10 Claims, 2 Drawing Sheets

(51) Int. Cl.

| | |
|---|---|
| *F17C 5/02* | (2006.01) |
| *B67D 7/36* | (2010.01) |
| *B67D 7/78* | (2010.01) |

(52) U.S. Cl.
CPC ..... *B67D 7/0496* (2013.01); *B67D 7/54* (2013.01); *B67D 7/36* (2013.01); *B67D 7/78* (2013.01); *F17C 5/02* (2013.01)

(56) References Cited

U.S. PATENT DOCUMENTS

| | | | |
|---|---|---|---|
| 6,170,539 | B1 | 1/2001 | Pope et al. |
| 2001/0020493 | A1 | 9/2001 | Nanaji |
| 2004/0177894 | A1 | 9/2004 | Nanaji |

FOREIGN PATENT DOCUMENTS

| | | | |
|---|---|---|---|
| CN | 202022744 | U | 11/2011 |
| CN | 202089758 | | 12/2011 |
| CN | 202246023 | | 5/2012 |
| CN | 102718178 | A | 10/2012 |
| CN | 202687941 | U | 1/2013 |
| CN | 203048574 | | 7/2013 |
| CN | 104528627 | A | 4/2015 |
| CN | 204369559 | U | 6/2015 |
| EP | 0653376 | | 5/1995 |
| FR | 2924706 | | 6/2009 |
| JP | 2013040651 | A | 2/2013 |

OTHER PUBLICATIONS

Second China Office Action for counterpart patent application/publication No. 201410811474.4.

Supplemental European Search Report for counterpart application No. EP 15 86 8998 dated Sep. 2, 2018.

Supplemental China Search Report for counterpart application No. 201410811474.

The Design and Optimization of the Frequency Conversion Controlled Vapor Recovery System Based on Temperature and Flow Signal by Liu Yajun, Liu Jun and Wang Yan (South China University of Technology).

FREQUENCY VARIABLE FUEL VAPOR RECOVERY CONTROL SYSTEM AND METHOD FOR FUEL DISPENSER WITH SELF-CALIBRATED VAPOR LIQUID RATIO

CROSS REFERENCE TO RELATED APPLICATIONS

This application claims the benefit of PCT International Application Serial No. PCT/CN2015/082837 filed on Jun. 30, 2016, which claims priority to Chinese Application Serial No. 201410811474.4 filed on Dec. 19, 2014, the entire contents of which are incorporated by reference.

TECHNICAL FIELD

The present invention relates to a fuel dispenser. More particularly, the present invention relates to a variable-frequency fuel vapor recovery control system and a method.

BACKGROUND

Currently, there are three types of gas station fuel vapor recovery technologies which can be categorized as primary recovery, secondary recovery and tertiary recovery systems:

(a) Primary recovery system refers to, as an fuel tank truck is discharging fuel into a fuel depot of a gas station, fuel vapor which is discharged from the fuel depot is recovered;

(b) Secondary recovery system refers to, as fuel gun is used to fill an automobile fuel tank with gasoline, fuel vapor discharged from the fuel tank is recovered; and (c) Tertiary recovery system generally refers to a recovery device being installed in the fuel depot to carry out fuel vapor separation on extracted fuel vapor, discharge air and liquefied fuel.

As the gas station-fuel vapor recovery standard of our country is becoming more and more strict, secondary fuel vapor recovery facilities start to become popularized and installed in gas stations. Currently, gas station fuel vapor recovery facilities that have high market shares all belong to foreign brands. According to models for controlling the fuel vapor amount/the fueling amount ratio (fuel vapor recovery ratio, A/L), there can be the following four types:

(1) Model of controlling regulating valve by fuel vapor flow: This model utilizes flow velocity during fueling to generate pressure to control the vapor intake amount of the regulating valve in order to achieve the fuel vapor recovery ratio of about 1:1. This model is adopted by Healy company and Elaflex company.

(2) Pulse sensor model adopting flow metering: This model utilizes a signal of a flow sensor during fueling to control a variable-frequency motor or adjust the opening degree of a proportional valve. When fuel flow is large, the voltage signal frequency of the pulse sensor increases, the rotational speed of the variable-frequency motor increases or the opening degree of the proportional valve increases accordingly. Such a model can achieve the fuel vapor recovery ratio of about 1:1. This model is adopted by fuel vapor recovery equipment manufacturers including companies such as Gilbarco in USA, Tokheim in Europe, Wayne and NP.

(3) Post-processing model: This model utilizes a vacuum pump to pump a great deal of air-containing fuel vapor adopting (1.4:1) to (2.4:1) during fueling back into a fuel tank, and, after the vapor pressure of the fuel tank is increased, the redundant fuel vapor is sent into a combustion tower and burnt, or is recovered by adsorption, or a membrane separation recovery device is installed. Main equipment suppliers include major companies in Europe and USA, such as Hasstech, hirt and OPW.

The above-mentioned fuel vapor recovery systems have the following defects:

(1) Since the saturated vapor pressure of easy-to-gasify media, such as gasoline, can increase significantly as temperature increases, the easy-to-gasify media, such as gasoline, will become more volatile at higher temperatures. Therefore, it would be unreasonable for the previous two models to maintain the fixed vapor liquid ratio of 1:1. On the contrary, if the vapor liquid ratio is high, using the post-processing mode, as an example, will result in fuel vapor loss in the fuel tank, and moreover, electrical energy will be wasted as well if the recovery ratio is too high.

(2) In the mode of regulating fuel vapor recovery flow by means of the proportional valve, the opening degree of the proportional valve is adjusted by a spool, and the position of the spool of the proportional valve will get loose after the proportional valve is used for a period of time; moreover, an on-site worker may adjust the screw of the spool of the proportional valve without permission, and as a result, the performance of the proportional valve can be changed, causing a nonlinear change in the vapor liquid ratio of the system.

(3) For the mode of regulating fuel vapor flow by means of the proportional valve or the mode of controlling the rotational speed of the motor of the vacuum pump only by the pulse frequency of flow metering, the system defaults the vapor recovery amount of the vacuum pump to be a constant; because the phenomena of vapor recovery amount decrease and insufficient suction exist in the vacuum pump of the on-site fuel vapor recovery system, these will cause great influence on the vapor liquid ratio of the system, and the system cannot be adjusted adaptively to achieve a correct vapor liquid ratio.

All the above-mentioned fuel vapor recovery systems do not have a real-time vapor liquid ratio display function, so that on-site workers may not be able to visually track of the working conditions of the systems, bringing difficulty to system maintenance.

In the process of transferring and metering fuel, especially gasoline, biofuel ethanol gasoline and other easy-to-gasify media, the fluid medium flows in a pipeline in the form of both vapor and liquid. The change of the physiochemical properties of the transferred medium (for example, the biofuel ethanol gasoline is easier to gasify) will inevitably affect the vapor liquid separation property in the process of pumping, and fuel vapor recovery control parameters will also need to be changed accordingly. The determination of the vapor liquid ratio in fuel vapor recovery is closely related to the process of transfer, and depends on factors such as pipeline conditions, fuel product properties, temperature and pressure condition in the process of transfer. Especially, temperature has significant influence on the volatility of easy-to-gasify media. According to a test, the environmental temperature of gas stations in our country is about 0 to 40° C. in general, and under this temperature condition, the variation range of the vapor liquid ratio of fuel vapor volatilization is about 1-1.4.

Based on the conditions of gas stations in our country, the above-mentioned fuel vapor recovery systems still have room for optimization, and the whole recovery systems can be made simpler and more efficient.

SUMMARY OF THE INVENTION

The objective of the present invention is to overcome the shortcomings and defects in the prior art and provide a variable-frequency fuel vapor recovery control system for a fuel dispenser with a self-calibrated vapor liquid ratio. The fuel vapor recovery control system utilizes the combination of a temperature signal and fueling amount signal to control speed by variable frequency to implement the adjustment of the fuel vapor recovery ratio, and further a feedback signal is output to the system by an fuel vapor recovery amount signal and the fueling amount signal to form a closed-loop recovery system, consequently, the self-adaptive adjustment of the whole recovery system is achieved, so that the fueling recovery ratio can be self-calibrated in a range of 1-1.4, tallying with the reality of gas stations in our country. The variable-frequency fuel gas recovery control system for a fuel dispenser with a self-calibrated vapor liquid ratio of the present invention is applicable to the fuel vapor recovery process of ordinary gasoline as well as ethanol gasoline. Meanwhile, the present invention provides a variable-frequency fuel vapor recovery control method for a fuel dispenser with a self-calibrated vapor liquid ratio, which can realize the variable-frequency self-adaptive control of fuel vapor recovery, helping to realize the accurate control of the fuel vapor recovery ratio.

In order to achieve the above-mentioned objective, the present invention is implemented by the following technical solution: a variable-frequency fuel vapor recovery control system for a fuel dispenser with a self-calibrated vapor liquid ratio, comprising a controller, a recovery electrical motor, a fuel vapor switching valve, a fuel gas recovery pump, a fuel tank, a fueling pump, a fuel gun, a temperature sensor and a fueling flowmeter which is used for measuring the fueling amount, wherein the fuel vapor switching valve, the fuel vapor recovery pump, the fuel tank, the fueling pump, the fuel gun and the temperature sensor are connected in sequence; the fueling flowmeter is arranged on a fueling pipeline, and is in signal connection with the controller, the recovery electrical motor and the fuel vapor recovery pump in sequence; the fuel vapor recovery control system is characterized in that the temperature sensor is in signal connection with the controller and is used to control the recovery electrical motor and the fuel vapor recovery pump by temperature signals; the fuel vapor recovery control system further comprises a fuel vapor flowmeter used for measuring the fuel vapor recovery amount recovery amount, which is in signal connection with the controller and which is used to control the recovery electrical motor and the fuel vapor recovery pump by fuel vapor recovery amount signals.

In the above-mentioned solution, the controller is also in signal connection with the temperature sensor while being in signal connection with the fueling flowmeter, so that the fuel vapor recovery ratio is controlled simultaneously by a fueling amount signal and a temperature signal, thereby implementing the preliminary adjustment of the fuel vapor recovery ratio; the controller of the present invention is also in signal connection with the fuel vapor flowmeter, so that the fuel vapor recovery ratio can also be corrected by the actual vapor liquid ratio fed back jointly by the fueling amount signal and the fuel vapor recovery amount signal simultaneously, consequently, the self-adaptive adjustment of the fuel vapor recovery ratio within a range of 1-1.4 is achieved, so that the recovery control system achieves a self-calibration function.

The fuel vapor flowmeter is arranged on a fuel vapor recovery pipeline between the fuel vapor switching valve and the fuel vapor recovery pump. The design can conveniently monitor the fuel vapor recovery amount of the recovery control system in real time.

The present invention further comprises a display device for displaying the vapor liquid ratio in real time, wherein the display device is connected to the controller; and the vapor liquid ratio refers to a ratio of the fuel vapor recovery amount to the fueling amount. Since the present invention has a real-time vapor liquid ratio display function, the working condition of the system can be visually known, which is favorable for system maintenance.

The controller is provided with more than two signal positions, and each signal position corresponds to a certain temperature sensing range; and each temperature sensing range corresponds to one fuel vapor recovery ratio. Each signal position corresponds to one fuel vapor recovery ratio, and thus the controller can determine which temperature sensing range temperature T fed back by the temperature is in, and then regulates the fuel vapor recovery ratio.

The signal positions are four positions which increase progressively in sequence or decrease progressively in sequence; the four signal positions respectively correspond to the following temperature sensing ranges in ascending order: (1) $T \leq 0°$ C.; (2) $0° C. < T \leq 20°$ C.; (3) $20° C. < T \leq 30°$ C.; (4) $T > 30°$ C.; and T is the temperature sensed by the temperature sensor. In this way, the controller only needs to judge the temperature signal positions for the temperature T fed back by the temperature sensor.

The fuel vapor recovery pump refers to a fuel vapor recovery vacuum pump; the controller refers to a frequency convertor controller; and the fuel vapor flowmeter refers to a VFM fuel vapor flowmeter.

The fuel vapor switching valve is arranged at the muzzle of the fuel vapor; the fuel vapor recovery control system further comprises a fuel vapor filter and a steady flow tank which are arranged on a fuel vapor recovery pipeline between the fuel vapor switching valve and the fuel vapor flowmeter, wherein the fuel vapor switching valve, the fuel vapor filter, the steady flow tank, the fuel vapor flowmeter, the fuel vapor recovery pump and the fuel vapor are connected in sequence. The fuel vapor flowmeter of the present invention is installed between the steady flow tank and the fuel vapor recovery pump, so that the effect of measuring the fuel vapor recovery amount can be increased.

Disclosed is a variable-frequency fuel vapor recovery control system for a fuel dispenser with a self-calibrated vapor liquid ratio, characterized by utilizing the combination of a temperature signal and a fueling amount signal to control the speed of the recovery electrical motor, so that the preliminary adjustment of the fuel vapor recovery ratio is implemented; then utilizing a fuel vapor recovery amount signal and the fueling amount signal to calculate the real-time vapor liquid ratio, and adopting the real-time vapor liquid ratio as an output feedback signal of the recovery control system, so that the recovery control system is formed into a closed-loop recovery control system, realizing the self-adaptive adjustment of the fuel vapor recovery ratio; and the vapor liquid ratio refers to a ratio of the fuel vapor recovery amount to the fueling amount.

In the above-mentioned solution, the recovery control method of the present invention can realize the variable-frequency self-adaptive control of fuel vapor recovery, being beneficial to realizing the accurate control of the fuel vapor recovery ratio.

More specifically, the recovery control method of the present invention includes the following steps:

Step 1: When a fuel dispenser operates, setting a fuel vapor recovery ratio δ according to a temperature signal monitored in real time, calculating an initial fuel vapor recovery amount $V_{fuel\ vapor}=\delta V_{fuel}$, and controlling the speed of the recovery electrical motor according to the initial fuel vapor recovery amount $V_{fuel\ vapor}$, so that the preliminary adjustment of the fuel vapor recovery ratio is implemented, wherein $V_{fuel}$ is the fueling amount monitored in real time;

Step 2: Calculating a real-time vapor liquid ratio $$\frac{A}{L}=\frac{V'_{fuel\ vapor}}{V'_{fuel}},$$

wherein $V_{fuel\ vapor}$ is the fuel vapor recovery amount monitored in real time;

Step 3: Comparing the vapor liquid ratio A/L with the fuel vapor recovery ratio δ set in Step 1, carrying out error correction on the vapor liquid ratio A/L, and controlling the speed of the recovery electrical motor according to the corrected vapor liquid ratio A/L, so that the self-adaptive adjustment of the fuel vapor recovery ratio is implemented.

In Step 1, setting the fuel vapor recovery ratio δ according to a temperature signal monitored in real time means: each temperature signal corresponding to a set temperature sensing range; each temperature sensing range corresponding to one fuel vapor recovery ratio, and selecting and setting the fuel vapor recovery ratio δ according to a temperature signal monitored in real time.

The control principle of the variable-frequency fuel vapor recovery control system for a fuel dispenser with a self-calibrated vapor liquid ratio of the present invention is as follows: an appropriate fuel vapor recovery ratio δ is selected and set by utilizing a temperature signal, it is calculated in real time that the needed initial fuel vapor recovery amount $V_{fuel\ vapor}=\delta V_{fuel}$ in combination with the fueling amount $V_{fuel}$, and then the output frequency is adjusted by the controller according to the fuel vapor recovery capability of the fuel vapor recovery system, thereby controlling the speed of the recovery electrical motor. In the process of operation, fuel vapor recovery amount $V'_{fuel\ vapor}$ is fed back by the VFM fuel vapor flowmeter, a real-time gas liquid ratio $$\frac{A}{L}=\frac{V'_{fuel\ vapor}}{V_{fuel}}$$

is calculated in combination with the fueling amount $V_{fuel}$, error correction is performed on the gas liquid ratio A/L by the frequency convertor controller, the speed of the recovery electrical motor is controlled according to the corrected vapor liquid ratio A/L, so that the self-adaptive adjustment of the fuel vapor recovery ratio is implemented, and the vapor liquid ratio A/L is displayed on a display screen in real time.

The specific control principle of the fuel vapor recovery control system of the present invention is as follows: the variable-frequency motor is controlled by utilizing a pulse signal of an encoder of the fueling flowmeter in fueling to implement the control of the fuel vapor recovery vacuum pump. When fuel flow is large, the voltage signal frequency of the pulse sensor increases, the frequency convertor controller changes frequency to increase the rotational speed of the motor, so that the rotational speed of the vacuum pump is regulated, thereby achieving an appropriate fuel vapor recovery ratio.

When temperature is high in summer, gasoline can be more easily volatilized, and under such a condition, only achieving the fuel vapor recovery ratio of 1:1 is not enough. Therefore, while the fueling amount is controlled, a temperature sensor signal is added, and temperature signals can be divided into four positions: 0° C. (and below), 0° C.-20° C., 20° C.-30° C. and 30° C. (and above), each position corresponds to one fuel vapor recovery ratio, thereby realizing the variation of the oil gas recovery ratio. The temperature sensor outputs an analog voltage of 0-5V. When the fueling temperature is high and the fueling amount is large, the voltage signal increases thereby increasing the rotational speed of the variable-frequency motor, as the rotational speed of the vacuum recovery pump increases, a higher fuel vapor recovery ratio can be obtained, thereby achieving the variable-frequency self-adaptive control of the fuel vapor recovery ratio in the range of 1-1.4.

In the operation of the system, by acquiring a pulse signal output by the VFM fuel vapor flowmeter, the frequency convertor controller calculates a ratio of the fueling amount to the fuel vapor recovery amount, so that a real vapor liquid ratio under the current condition of the system can be known, the error of the vapor liquid ratio of the system is corrected, the speed of the recovery electrical motor is controlled according to the corrected vapor liquid ratio, so that the self-adaptive adjustment of the fuel vapor recovery ratio is implemented, and meanwhile, the vapor liquid ratio is displayed on the display screen in real time.

Compared with the prior art, the present invention has the following advantages and beneficial effects:

1. The recovery control system of the present invention has a self-calibration function, utilizes the combination of a temperature signal and a fueling amount signal to control speed by variable frequency to implement the adjustment of the fuel vapor recovery ratio, further a feedback signal is output to the system by the fuel vapor recovery amount signal and the fueling amount signal, so that a closed-loop recovery system is formed, consequently, the self-adaptive adjustment of the whole recovery system is achieved, so that the fuel vapor recovery ratio can be within a range of 1-1.4, tallying with the reality of gas stations in our country.
2. The recovery control system of the present invention reasonably sets a fuel vapor recovery ratio and a vapor liquid ratio and can perform self-calibration, helping to protect the environment and save energy.
3. Since the recovery control system of the present invention has a real-time vapor liquid ratio display function, the working condition of the system can be known more visually, which is favorable for system maintenance.
4. The variable-frequency fuel vapor recovery control system for a fuel dispenser with a self-calibrated vapor liquid ratio of the present invention does not need to utilize a temperature signal to control the opening degree of a proportional valve to achieve an adjustable fuel vapor recovery ratio, and the vapor flow of a fuel vapor recovery control system with a proportional valve and the fuel vapor recovery control system not adopting the proportional valve in the present invention are respectively 46 L/min and 60 L/min at the same frequency of 50 Hz, so the fuel vapor recovery control system not adopting the proportional valve in the present invention greatly increases the flow of vapor.

5. The recovery control method of the present invention can realize the variable-frequency self-adaptive control of fuel vapor recovery, helping to realize the accurate control of the fuel vapor recovery ratio.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
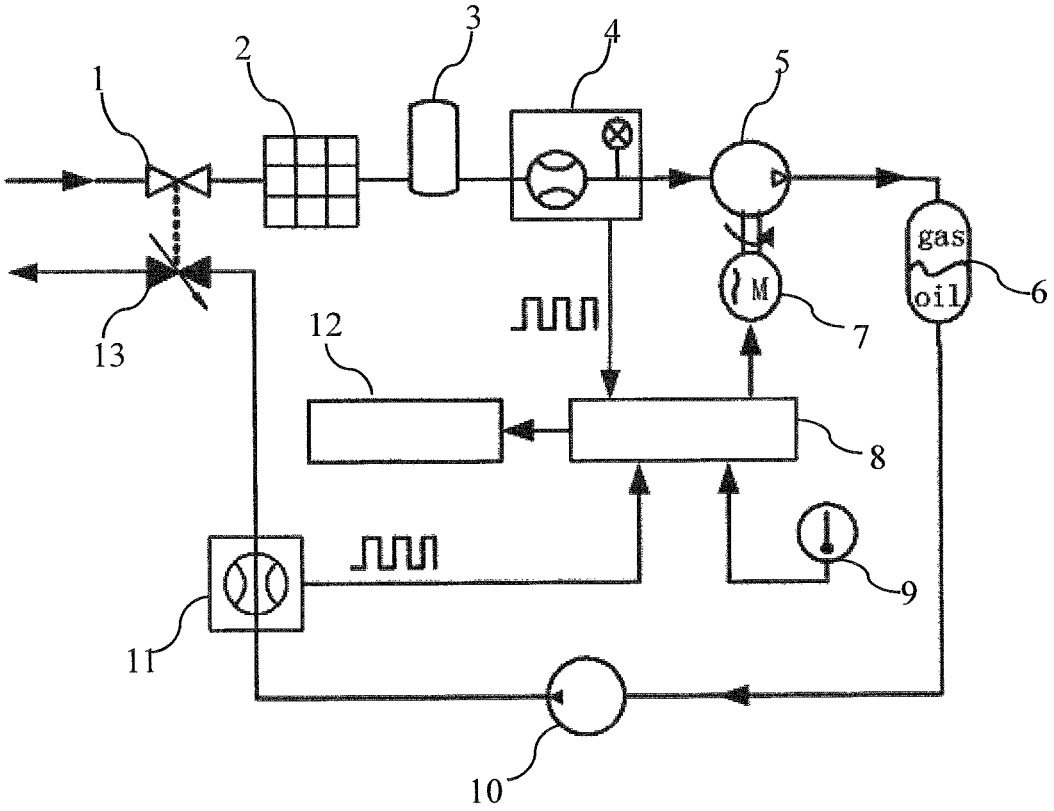
FIG. 1 is a schematic view of a variable-frequency fuel vapor recovery control system for a fuel dispenser with a self-calibrated vapor liquid ratio in accordance with the present invention.

Referring to the Figures, wherein like numerals indicate corresponding parts throughout the several views, a variable-frequency fuel vapor recovery control system is shown in FIG. 1. The present invention is further described in detail below in reference to the drawings and a specific embodiment.

The structural schematic diagram of a variable-frequency fuel vapor recovery control system for a fuel dispenser with a self-calibrated vapor liquid ratio of the present invention is generally shown in FIG. 1. The recovery control system comprises a frequency convertor controller 8, a recovery electrical motor 7, a fuel vapor switching valve 1, a fuel vapor recovery vacuum pump 5, a fuel tank 6, a fueling pump 10, a fuel gun 13, a temperature sensor 9 and a fueling flowmeter 11 for measuring the fueling amount, wherein the fuel vapor switching valve 1, the fuel vapor recovery pump 5, the fuel tank 6, the fueling pump 10, the fuel gun 13 and the temperature sensor 9 are connected in sequence, the fueling flowmeter 11 is arranged on a fueling pipeline, and the fueling flowmeter 11 is in signal connection with the frequency convertor controller 8, the recovery electrical motor 7 and the fuel vapor recovery pump 5 in sequence. The temperature sensor 9 of the present invention is in signal connection with the frequency convertor controller 8, and is used to control the recovery electrical motor 7 and the fuel vapor recovery vacuum pump 5 by temperature signals. The present invention further comprises a VFM fuel vapor flowmeter 4 for measuring the fuel vapor recovery amount, wherein the VFM fuel vapor flowmeter 4 is in signal connection with the frequency convertor controller 8, and is used to control the recovery electrical motor 7 and the fuel vapor recovery vacuum pump 5 by fuel vapor recovery amount signals. The fuel vapor switching valve 1 is arranged at the muzzle of the fuel gun 13; the present invention further comprises an a fuel vapor filter 2 and a steady flow tank 3 which are arranged on a fuel vapor recovery pipeline between the fuel vapor switching valve 1 and the VFM fuel vapor flowmeter 4, wherein the fuel vapor switching valve 1, the fuel vapor filter 2, the steady flow tank 3, the VFM fuel vapor flowmeter 4, the fuel vapor recovery vacuum pump 5 and the fuel tank 6 are connected in sequence.

The VFM fuel vapor flowmeter 4 of the present invention is installed on a fuel vapor recovery pipeline between the steady flow tank 3 and the fuel vapor recovery vacuum pump 5, so that the effect of measuring the fuel vapor recovery amount can be increased. In order to more visually know the working condition of the system, the present invention further comprises a display device 12 for displaying a vapor liquid ratio in real time, wherein the display device 12 is connected to a frequency convertor controller 8. The present invention has a real-time vapor liquid ratio display function, which is favorable for system maintenance.

The controller 8 is provided with more than two signal positions, each signal position corresponds to a certain temperature sensing range, and each temperature sensing range corresponds to one fuel vapor recovery ratio. Because each signal position corresponds to one fuel vapor recovery ratio, the variation of the fuel vapor recovery ratio can be adapted. More specifically, the signal positions include four positions which increase progressively in sequence or decrease progressively in sequence; the four signal positions respectively correspond to the following temperature sensing ranges in ascending order: (1) $T \leq 0°$ C.; (2) $0° C. < T \leq 20°$ C.; (3) $20° C. < T \leq 30°$ C.; (4) $T > 30°$ C.; with T being the temperature sensed by the temperature sensor. In this way, the controller only needs to determine the temperature signal positions for the temperature T fed back by the temperature sensor 9.

Figure 2:
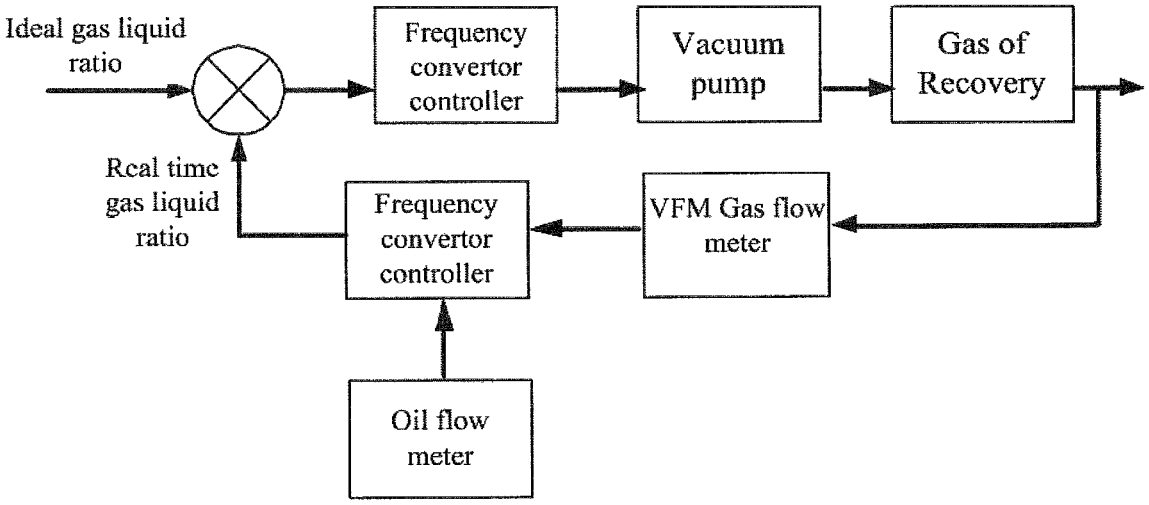
FIG. 2 is a schematic view of a control principle of a variable-frequency fuel vapor recovery control method for a fuel dispenser with a self-calibrated vapor liquid ratio in accordance with the present invention.

A diagram of a control principle of the variable-frequency fuel vapor recovery control system for a fuel dispenser with a self-calibrated vapor liquid ratio of the present invention is shown in FIG. 2. The fuel vapor recovery control method utilizes the combination of a temperature signal and a fueling amount signal to control the speed of the recovery electrical motor, so that the preliminary adjustment of the fuel vapor recovery ratio is implemented; then utilizing a fuel vapor recovery amount signal and the fueling amount signal to calculate the real-time fuel vapor liquid ratio, and adopting the real-time fuel vapor liquid ratio as an output feedback signal of the recovery control system, so that the recovery control system is formed into a closed-loop recovery control system, realizing the self-adaptive adjustment of the fuel vapor recovery ratio; and the fuel vapor liquid ratio refers to a ratio of the fuel vapor recovery amount to the fueling amount.

More specifically, the recovery control method of the present invention includes the following steps:

Step 1: When a fuel dispenser operates, setting a fuel vapor recovery ratio δ according to a temperature signal monitored in real time, calculating an initial fuel vapor recovery amount $V_{fuel\ vapor} = \delta V_{fuel}$, and controlling the speed of the recovery electrical motor according to the initial fuel vapor recovery amount $V_{fuel\ vapor}$, so that the preliminary adjustment of the fuel vapor recovery ratio is implemented, wherein $V_{fuel}$ is the fueling amount monitored in real time;

Step 2: Calculating a real-time vapor liquid ratio $$\frac{A}{L} = \frac{V'_{fuel\ vapor}}{V_{fuel}},$$

wherein $V'_{fuel\ vapor}$ is the fuel vapor recovery amount monitored in real time;

Step 3: Comparing the vapor liquid ratio A/L with the fuel vapor recovery ratio δ set in Step 1, carrying out error correction on the vapor liquid ratio A/L, and controlling the speed of the recovery electrical motor according to the corrected vapor liquid ratio A/L, so that the self-adaptive adjustment of the fuel vapor recovery ratio is implemented.

In Step 1, setting fuel vapor recovery ratio δ according to a temperature signal monitored in real time means: each temperature signal corresponding to a set temperature sensing range; each temperature sensing range corresponding to one fuel vapor recovery ratio, and selecting and setting the fuel vapor recovery ratio δ according to a temperature signal monitored in real time.

The control principle of the variable-frequency fuel vapor recovery control system for a fuel dispenser with a self-calibrated vapor liquid ratio of the present invention is as follows: an appropriate fuel vapor recovery ratio δ is selected and set by utilizing a temperature signal, it is calculated in real time that the needed initial fuel vapor recovery amount $V_{fuel\ vapor}=\delta V_{fuel}$ in combination with the fueling amount $V_{fuel}$, and then the output frequency is adjusted by the frequency convertor controller according to the fuel vapor recovery capability of the fuel vapor recovery system, thereby controlling the speed of the recovery electrical motor. In the process of operation, fuel vapor recovery amount $V'_{fuel\ vapor}$ is fed back by the VFM fuel vapor flowmeter, a real-time vapor liquid ratio $$\frac{A}{L}=\frac{V'_{fuel\ vapor}}{V_{fuel}}$$

is calculated in combination with the fueling amount $V_{fuel}$, error correction is performed on the vapor liquid ratio A/L by the frequency convertor controller, the speed of the recovery electrical motor is controlled according to the corrected vapor liquid ratio A/L, so that the self-adaptive adjustment of the fuel vapor recovery ratio is implemented, and the vapor liquid ratio A/L is displayed on a display screen in real time.

The above-mentioned embodiment is a preferred embodiment of the present invention, but the embodiments of the present invention are not limited by the above-mentioned embodiment, and any other alterations, modifications, replacements, combinations and simplifications which are made without departing from the spirit and principle of the present invention should all be equivalent replacement patterns, and should all be included in the protection scope of the present invention.

The invention claimed is:

1. A variable-frequency fuel vapor recovery control system for a fuel dispenser including a self-calibrated vapor liquid ratio comprising, a fuel vapor switching valve;

a fuel vapor recovery pump disposed in fluid communication with said fuel vapor switching valve;

a fuel tank disposed in fluid communication with said fuel vapor recovery pump;

a fueling pump disposed in fluid communication with said fuel tank;

a fuel gun disposed in fluid communication with said fueling pump;

a fueling pipeline extending between said fuel gun and said fueling pump to connect said fuel gun with said fueling pump;

a temperature sensor disposed in connection with said fuel gun;

a fueling flowmeter disposed on said fueling pipeline;

a controller disposed in signal connection with said fueling flowmeter;

a recovery electrical motor disposed in connection with said vapor fuel recovery pump;

said temperature sensor being disposed in signal connection with said controller for generating temperature signals to control said recovery electrical motor and said vapor fuel recovery pump; and a fuel vapor flowmeter disposed in signal connection with said controller for measuring a fuel vapor recovery amount and generating a fuel vapor recovery amount signal to control said recovery electrical motor and said fuel vapor recovery pump.

2. The variable-frequency fuel vapor recovery control system for a fuel dispenser including a self-calibrated vapor liquid ratio according to claim 1 further including a fuel vapor recovery pipeline connecting said fuel vapor switching valve and said fuel vapor recovery pump with said fuel vapor flowmeter being attached on said fuel vapor recovery pipeline.

3. The variable-frequency fuel vapor recovery control system for a fuel dispenser including a self-calibrated vapor liquid ratio according to claim 2 wherein said fuel vapor switching valve is arranged at a muzzle of said fuel gun and further includes a fuel vapor filter and a steady flow tank disposed on said fuel vapor recovery pipeline between said fuel vapor switching valve and said fuel vapor flowmeter whereby said fuel vapor switching valve, said fuel vapor filter, said steady flow tank, said fuel vapor flowmeter, said fuel vapor recovery pump and said fuel tank are connected in sequence.

4. The variable-frequency fuel vapor recovery control system for a fuel dispenser including a self-calibrated vapor liquid ratio according to claim 1 further including a display device connected to said controller for displaying a vapor liquid ratio in real time whereby said vapor liquid ratio is a ratio of fuel vapor recovery amount to fueling amount.

5. The variable-frequency fuel vapor recovery control system for a fuel dispenser including a self-calibrated vapor liquid ratio according to claim 4 wherein said controller is provided with more than two signal positions, and each of said signal positions corresponds to a temperature sensing range with each of said temperature sensing ranges corresponds to one fuel vapor recovery ratio.

6. The variable-frequency fuel vapor recovery control system for a fuel dispenser including a self-calibrated vapor liquid ratio according to claim 5 wherein said temperature sensing ranges are defined in ascending order: (1) $T\leq 0°$ C.; (2) $0°$ C.$<T\leq 20°$ C.; (3) $20°$ C.$<T\leq 30°$ C.; (4) $T>30°$ C. and said signal positions increase progressively or decrease progressively and respectively correspond to said temperature sensing ranges with T being temperature sensed by said temperature sensor.

7. The variable-frequency fuel vapor recovery control system for a fuel dispenser including with a self-calibrated vapor liquid ratio according to claim 1 wherein said fuel vapor recovery pump is a fuel vapor recovery vacuum pump, said controller is a frequency convertor controller, and said fuel vapor flowmeter is a VFM oil gas flowmeter.

8. A variable-frequency fuel vapor recovery control method for a fuel dispenser including a self-calibrated vapor liquid ratio, said method including the steps of, utilizing a combination of a temperature signal and a fueling amount signal to control a recovery electrical motor speed to provide a preliminary adjustment of a fuel vapor recovery ratio;

utilizing a fuel vapor recovery amount signal and the fueling amount signal to determine a real-time vapor liquid ratio, and adopting the real-time gas liquid ratio as an output feedback signal of a recovery control system to form a closed-loop recovery control system, and providing a self-adaptive adjustment of the fuel vapor recovery ratio with the real-time vapor liquid ratio being defined as a ratio of a fuel vapor recovery amount to a fueling amount.

9. The variable-frequency fuel vapor recovery control method for a fuel dispenser including a self-calibrated vapor liquid ratio according to claim 8 further including the steps of:

Step 1: as the fuel dispenser operates, setting a fuel vapor recovery ratio δ according to a temperature signal monitored in real time, determining an initial fuel vapor recovery amount $V_{fuel\ vapor}=\delta V_{fuel}$, and controlling the speed of the recovery electrical motor according to the initial fuel vapor recovery amount $V_{fuel\ vapor}$ to implement the preliminary adjustment of the $V_{fuel\ vapor}$ recovery ratio with $V_{fuel}$ being the fueling amount monitored in real time;

Step 2: determining a real-time vapor liquid ratio $$\frac{A}{L}=\frac{V'_{fuel\ vapor}}{V_{fuel}},$$

with $V'_{fuel\ vapor}$ being the fuel vapor recovery amount monitored in real time;

Step 3: referencing the real-time vapor liquid ratio A/L with the fuel vapor recovery ratio δ in said Step 1 and carrying out error correction on the real-time vapor liquid ratio A/L and controlling the speed of the recovery electrical motor in response to the corrected real-time vapor liquid ratio A/L to implement the self-adaptive adjustment of fuel vapor recovery ratio.

10. The variable-frequency fuel vapor recovery control method for a fuel dispenser including a self-calibrated vapor liquid ratio according to claim 9 wherein setting the fuel vapor recovery ratio δ according to a temperature signal monitored in real time of said Step 1 is further defined as corresponding each temperature signal with a set temperature sensing range; corresponding each temperature sensing range with one fuel vapor recovery ratio, and selecting and setting fuel vapor recovery ratio δ according to a temperature signal monitored in real time.

* * * * *